US007027596B1

(12) United States Patent
Craig

(10) Patent No.: US 7,027,596 B1
(45) Date of Patent: Apr. 11, 2006

(54) APPARATUS FOR RELEASING TELEDAPT CABLES FROM DEEPLY RECESSED RJ CONNECTORS

(75) Inventor: Peter Mathieson Craig, Kanata (CA)

(73) Assignee: Mitel Networks Corporation, Ottawa (CA)

( * ) Notice: Subject to any disclaimer, the term of this patent is extended or adjusted under 35 U.S.C. 154(b) by 440 days.

(21) Appl. No.: 09/713,909

(22) Filed: Nov. 16, 2000

(30) Foreign Application Priority Data

Nov. 16, 1999 (GB) ..... 9926945

(51) Int. Cl.
*H04M 1/00* (2006.01)

(52) U.S. Cl. ..... 379/438; 439/352

(58) Field of Classification Search ..... 379/438, 379/445; 439/344, 354, 352; 385/100
See application file for complete search history.

(56) References Cited

U.S. PATENT DOCUMENTS 5,217,384 A 6/1993 Merten et al.
5,330,366 A * 7/1994 Tsuji et al. ..... 439/352
5,405,271 A 4/1995 Bauer et al.
5,628,648 A * 5/1997 Higgins et al. ..... 439/352
6,174,190 B1 * 1/2001 Tharp et al. ..... 439/352
6,456,768 B1 * 9/2002 Boncek et al. ..... 385/100

* cited by examiner

*Primary Examiner*—Ahmad F. Matar
*Assistant Examiner*—Rasha S. Al-Aubaidi
(74) *Attorney, Agent, or Firm*—Fay, Sharpe, Fagan, Minnich & McKee, LLP

(57) ABSTRACT

There is provided, in combination, male and female cooperating teledapt connectors located in a recess with respect to a mounting surface so as to minimize electrostatic discharge between an operator's hand and the connectors, wherein the male connector has a main body from which a tongue projects, and the female connector defines a groove in which the tongue is adapted to lie. The tongue has shoulders which, when the connectors are put together, come into contact with abutments formed in the female connector, such contact preventing release of the connectors until pressure is exerted to move the tongue toward the main body and thus to break contact between the shoulders and the abutments. The key to achieving this is the provision of an actuator having an attachment portion and an operative portion, the attachment portion being adapted to mount the operative portion so that the operative portion extends adjacent the tongue and projects out of the recess far enough to be manipulated so as to move the tongue toward said main body far enough to break contact between the shoulder means and the abutment means.

11 Claims, 2 Drawing Sheets

FIG.6.
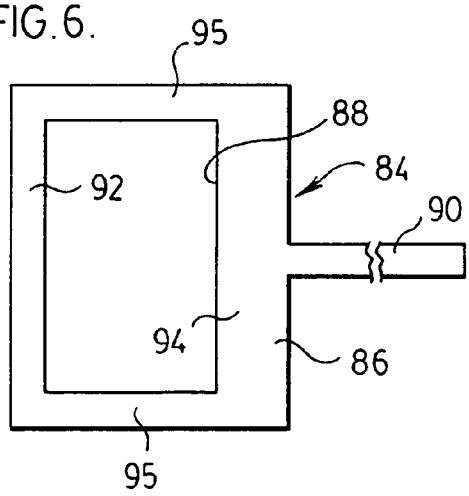
FIG. 7.
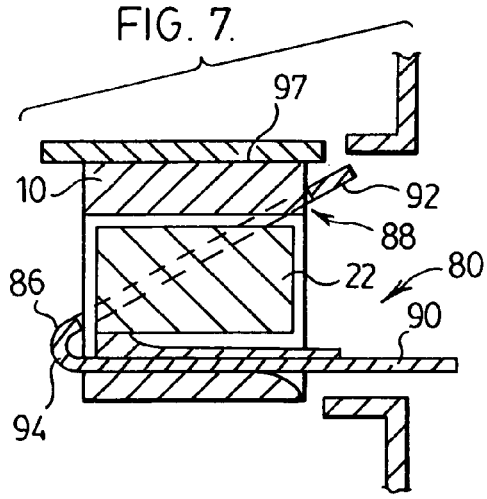
FIG.8.
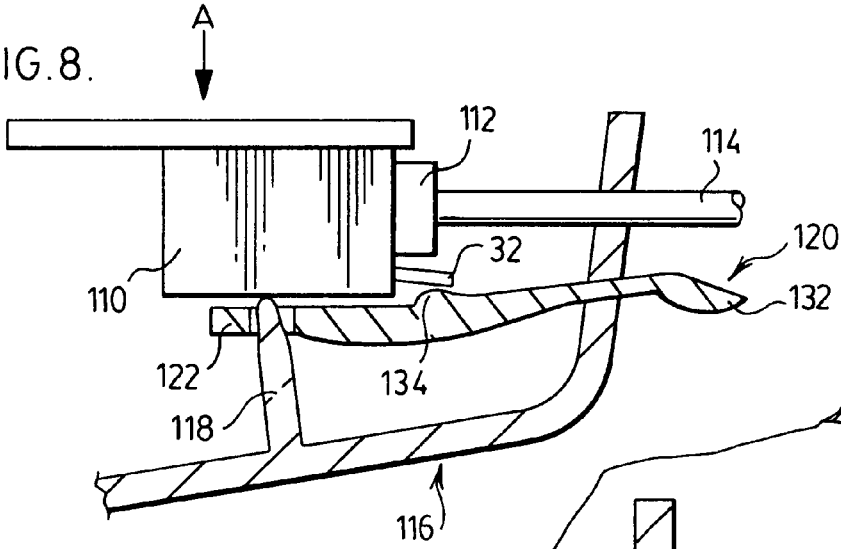
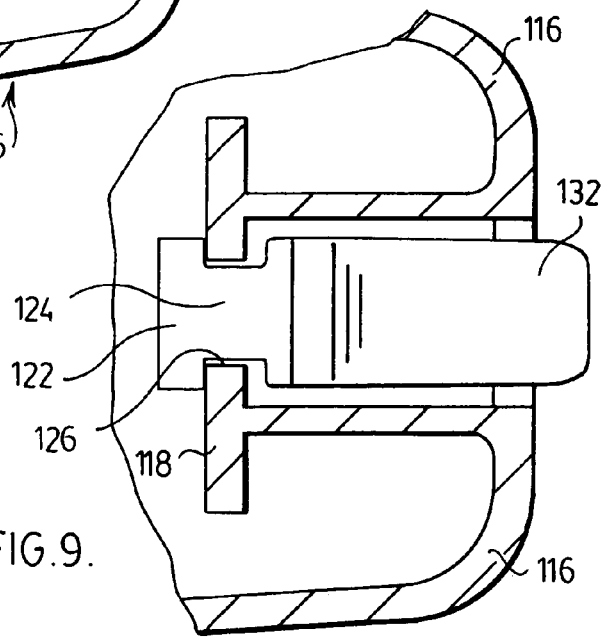
FIG.9.

APPARATUS FOR RELEASING TELEDAPT CABLES FROM DEEPLY RECESSED RJ CONNECTORS

BACKGROUND OF THIS INVENTION

The use of teledapt cabling in the telecom industry is widespread, and in many cases the parts are intended to be handled manually for at least connect/disconnect purposes. This exposes the equipment to the potential of static discharge (ESD or electrostatic discharge) between the connector and the person who is connecting or disconnecting the cable manually. This problem can be overcome by recessing the connector in the housing to create a greater air gap between the conductors in the connector and the fingers of the manipulator. However, this negates the ease of use by requiring some sort of tool or aid to deactivate the locking arm on the teledapt connector to remove the cable (i.e. to release the male connector from the female connector).

In the past, ESD requirements were not as high, and the electronic circuitry was designed to withstand the static discharge. Currently, however, many connectors are recessed, reducing the ease of disconnect.

It is therefore evident that the industry requires a teledapt design in which the connectors are recessed, along with some modality allowing the connectors to be easily released from one another without increased risk of ESD.

GENERAL DESCRIPTION OF THIS INVENTION

More particularly, this invention provides, for use with male and female cooperating teledapt connectors located in a recess with respect to a mounting surface so as to minimize electrostatic discharge between an operator's hand and the connectors, in which the male connector has a main body from which a tongue projects, the tongue being adapted to lie in a groove defined by the female connector, the tongue defining shoulder means which, when the connectors are connected, come into contact with abutment means formed in the female connector, said contact preventing dislodgement of the connectors until pressure is exerted to move the tongue toward said main body to a sufficient extent to break contact between said shoulder means and said abutment means:

an actuator having an attachment portion and an operative portion, the attachment portion being adapted to mount the operative portion so that the operative portion extends adjacent the tongue and projects out of the recess far enough to be manipulated so as to move the tongue toward said main body far enough to break contact between the shoulder means and the abutment means.

Further, this invention provides, in combination:

male and female cooperating teledapt connectors located in a recess with respect to a mounting surface so as to minimize electrostatic discharge between an operator's hand and the connectors, the male connector having a main body from which a tongue projects, the female connector defining a groove in which said tongue is adapted to lie, the tongue defining shoulder means which, when the connectors are connected, comes into contact with abutment means formed in the female connector, said contact preventing dislodgement of the connectors until the tongue moves toward said main body far enough to break contact between said shoulder means and said abutment means, and an actuator having an attachment portion and an operative portion, the attachment portion being adapted to mount the operative portion so that the operative portion extends adjacent the tongue and projects out of the recess far enough to be manipulated manually so as to move the tongue toward said main body far enough to break contact between the shoulder means and the abutment means.

GENERAL DESCRIPTION OF THE DRAWINGS

Several embodiments of this invention are illustrated in the accompanying drawings, in which like numerals denote like parts throughout the several views, and in which:

FIG. 6 is a plan view of a second embodiment of an actuator;

FIG. 7 is a vertical sectional view, similar to FIG. 4, showing the use of the embodiment of FIG. 6;

FIG. 8 is a sectional view illustrating a third embodiment of an actuator for use with this invention; and FIG. 9 is a partial plan view of the actuator of FIG. 8.

Figure 1:
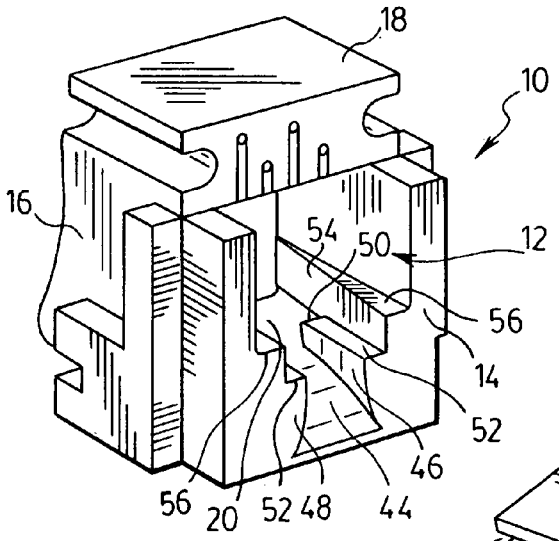
FIG. 1. (PRIOR ART)
FIG. 1 is a perspective view of a conventional female teledapt connector.

Attention is first directed to FIG. 1, showing the female connector in a particular embodiment. It is to be stressed that much of the structure illustrated in FIG. 1 has to do with mounting the connector in the appropriate environment, and has nothing at all to do with this invention.

In FIG. 1, the female connector shown generally at 10 is essentially a hollow member having a central opening 12 defined between a rightward wall portion 14, a leftward wall portion 16, a top wall portion 18, and a bottom wall portion 20. The details of the structure of the bottom wall 20 will be provided below.

Figure 2:
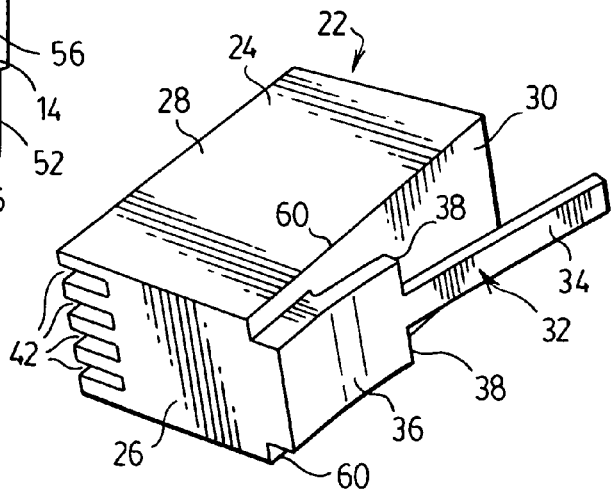
FIG. 2. (PRIOR ART)
FIG. 2 is a perspective view of a male teledapt connector designed to cooperate with the female connector of FIG. 1.
Figure 3:
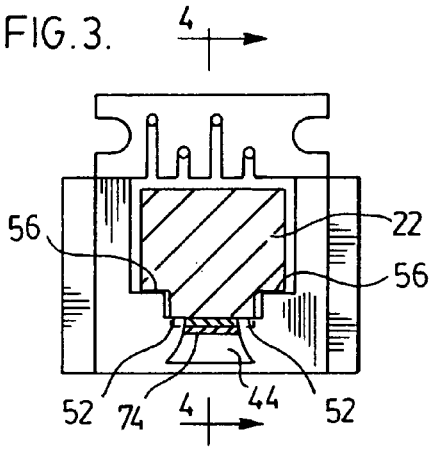
FIG. 3 is an end elevational view of the female connector of FIG. 1, showing the male connector of FIG. 2 in section.

However, attention is first directed to FIG. 2, showing the male teledapt connector 22. The connector 22 has a main body 24 generally in the shape of a rectangular parallelepiped defined by a forward wall 26, a side wall 28, a bottom wall 30, and the opposite wall for each of these (not visible in FIG. 2).

A tongue 32 projects from the bottom wall 30 of the male connector 22. The tongue 32 has a relatively narrow end portion 34 and a relatively wide mounting portion 36. The wide mounting portion 36 is formed integrally with, or is otherwise adhered or attached to, the bottom wall 30 of the male connector 22. Between the narrow portion 34 and the wide portion 36, the tongue 32 defines bilateral shoulders 38.

The male connector shown in FIG. 2 has the usual grooves, four shown at 42, which cooperate with free wire contacts in the female member 10. These portions are conventional and play no part in the present invention. It is therefore unnecessary to describe or show them.

Attention is now directed to FIG. 1, particularly to the structure of the bottom wall 20, and the lower portion of the side walls 14 and 16.

An upwardly open groove 44 is defined between a first short ledge 46 and a second short ledge 48. Each ledge has a vertical inner wall which is substantially parallel to the other. The spacing between the ledges 46 and 48 is such as to receive the narrow portion 34 of the tongue 32 with a small amount of play. Each of the ledges 46 and 48 terminates in an abutment, which in FIG. 1 is identified by the numeral 50. In the illustration of FIG. 1, the abutments 50 face away from the viewer, and thus are not directly seen.

The top surfaces 52 of the ledges 46, 48 are relatively flat and parallel with the bottom wall of the female connector. Further, each top surface 52 meets an upwardly extending wall 54, thus creating an L-shaped flange adapted to receive one side of the wide portion 36 of the tongue 32 relatively snugly, but so as to permit movement of the connectors with respect to each other.

Each side wall has a further ledge 56 on which the corners 60 of the male connector shown in FIG. 2 are adapted to rest.

It can be visualized that, as the male connector of FIG. 2 is inserted (with the end 26 foremost) into the opening 12 of the female connector shown in FIG. 1, entering from the rightward side (the only way it can enter), the edges 60 will engage the ledges 56, while the wide portion 36 of the tongue 32 will engage the ledges 52, and the narrow portion 34 of the tongue 32 will lie in the groove 44 defined between the side walls of the ledges 46 and 48. When the point is reached, during the insertion of the connector of FIG. 2, where the shoulders 38 arrive at the abutments 50, the shoulders 38 will snap down "behind" the abutments 50, and it will not be possible to remove the male connector from the female connector (at least, not by simply pulling on the pieces).

In order to release the connectors from one another, the wide portion 36 adjacent the shoulders 38 must be moved inwardly toward the bottom wall 30. This will raise the shoulders 38 to the point where they are free of the abutments 50. At this point, the male member can be withdrawn outwardly (to the right in FIG. 4). Since the connectors are well recessed, it is not possible to simply reach in and force the tongue inwardly against the main body of the male connector 22. Because of the recess, there is no room to do so.

Figure 5:
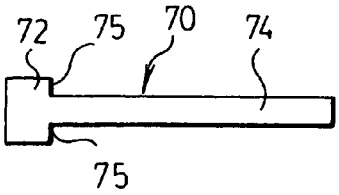
FIG. 5 is a plan view of a first embodiment of an actuator for use with this invention.

To remedy this problem, there is provided a first embodiment of an actuator 70, the general shape of which is shown in FIG. 5. The actuator 70 has an attachment portion 72 which is substantially rectangular, and an operative portion in the form of an elongate strap 74 extending perpendicularly from the mid-region of one rectangular side of the attachment portion. The attachment portion 72 is configured for retention within the female connector 10 with the strap 74 lying between the narrow portion 34 of the tongue 32 and the groove in the female member 10 which receives the tongue. Buttress portions 75 engage the abutments 50, preventing removal of the actuator 70 through the entry side (toward the viewer in FIG. 1).

Generally, there is always a certain amount of "play" in terms of vertical movement of the male connector within the female connector, and this "play" is sufficient to permit the presence of the strap 74, so long as it is not too thick.

Figure 4:
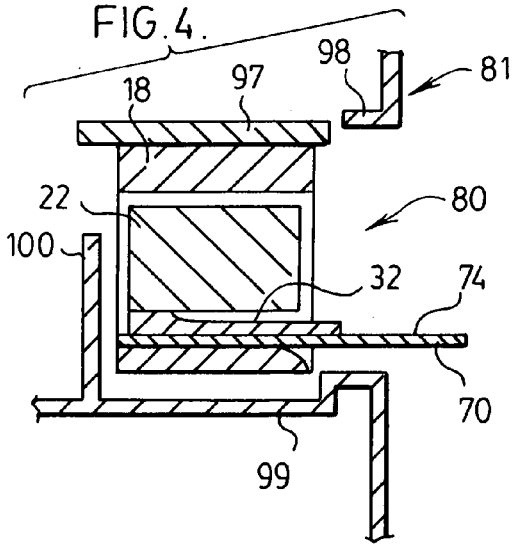
FIG. 4 is a vertical sectional view, taken at the line 44 in FIG. 3.

FIG. 4 shows the engagement of the male and female connectors at the bottom of a recess 80 in a mounting surface 81, with the strap 74 extending outwardly of the recess 80, so that it can be manipulated. Upward movement of the strap 74 will push the tongue 32 toward the main body of the connector 22, thus breaking contact between the shoulders 38 and the abutments 50, and doing so at a distance from the electrical portion, which is sufficient to restrain ESD.

FIG. 6 shows a different actuator configuration. Specifically, an actuator 84 has an attachment portion 86, which is substantially rectangular, and which has a rectangular opening 88. An operative portion in the form of an elongate strap 90 extends from the middle of one side of the rectangular attachment portion 86.

More particularly, the attachment portion 86 has a first leg 92 remote from the strap 90, a second leg 94 opposed to the leg 92 (and integral with the strap 90), and two side legs 95.

Attention is directed to FIG. 7, showing the use of the embodiment illustrated in FIG. 6. In FIG. 7, the attachment portion 86 receives the entire female connector 10 within its opening 88, and extends at an angle in order not to interfere with insertion of the male connector 22 into the female connector 10. It will be noted that the elongate strap 90 is folded over to extend into the female connector and along the groove 44. It will further be noted that the strap 90 extends beyond the front of the opening 80 constituting the recess for the teledaptor.

In both FIGS. 4 and 7, a printed circuit board 97 is illustrated.

Returning briefly to FIG. 4, it will be noted that upper and lower components 98 and 99 have been partly illustrated, to represent the context of use. The lowermost component 99 includes an upstanding buttress wall 100 which is intended to prevent removal of the actuator 70 to the left (as pictured in FIG. 4). No such buttress is necessary for FIG. 7, since the lodgement of the female connector 10 within the opening 88 will serve to keep the strap 90 in place.

The actuator 70 may be made of an electrically conductive material, provided ESD is not a concern. Typically, however, the insert would be of a non-electrically conductive material, since ESD is the main reason for considering the placement of the connectors at the bottom of a recess.

Attention is now directed to FIGS. 8 and 9, showing a third embodiment of the actuator provided herein.

In these figures, the female connector is illustrated at 110, and a projecting portion of a male connector is shown at 112. The extremity of a tongue 32 is illustrated, projecting rightwardly out of the female connector 110. A teledapt cable is shown at 114.

Partly shown is a structure 116 representing the portion of a telephone set where the teledapt connection is to be made. The structure 116 has an upstanding tab 118 which cooperates with an actuator 120. The actuator 120 has an attachment portion 122 which is waisted as can be seen in FIG. 9. This provides a neck 124 which sits loosely within a U-shaped groove 126 in the tab 118 and which permits pivoting of the actuator 120. Extending rightwardly from the attachment portion 122 is an operative portion 132, which includes an upstanding bulge portion 134, shown in FIG. 8 to be directly adjacent the end of the tongue 32. The rightward extremity of the operative portion 132 extends out of a recess holding the female connector 110.

It will be evident, particularly from FIG. 8, that upward pressure on the rightward end of the operative portion of the actuator 120 will communicate pressure to the tongue 32 and raise it upwardly far enough to release the male and female connectors from one another.

While several embodiments of this invention have been illustrated in the accompanying drawings and described hereinabove, it will be evident to those skilled in the art that changes and modifications may be made therein, without departing from the essence of this invention, as set forth in the appended claims.

The embodiments of the invention in which an exclusive property or privilege is claimed are defined as follows:

1. For use with male and female cooperating teledapt connectors located in a recess with respect to a mounting surface so as to minimize electrostatic discharge between an operator's hand and the connectors, in which the male connector has a main body from which a tongue projects, the tongue being adapted to lie in a groove defined by the female connector, the tongue defining shoulder means which, when the connectors are axially connected, come into contact with abutment means formed in the female connector, said contact with abutment means formed in the female connector, said contact preventing dislodgement of the connectors until pressure is exerted to move the tongue toward said main body to move the shoulder means toward the main body to a sufficient extent to break contact between said shoulder means and said abutment means:

an actuator having an attachment portion and an operative portion, the attachment portion being adapted to mount the operative portion so that the operative portion extends adjacent the tongue and projects out of the recess far enough to be transversely manipulated so as to move the tongue toward said main body such that the shoulder means moves toward said main body far enough to break contact with the abutment means.

2. The invention claimed in claim 1, in which the attachment portion of the actuator is substantially rectangular, and in which the operative portion is an elongate strap which extends perpendicularly from one rectangular side of the attachment portion.

3. The invention claimed in claim 2, in which the attachment portion of the actuator is configured for lodgement within the female connector and includes contact means for contacting said abutment means, thereby preventing removal of the actuator in the direction in which the elongate strap projects.

4. The invention claimed in claim 1, in which the actuator is made of an electrically conductive material.

5. The invention claimed in claim 1, in which the actuator is made of an electrically non-conductive material.

6. In combination:

male and female cooperating teledapt connectors located in a recess with respect to a mounting surface so as to minimize electrostatic discharge between an operator's hand and the connectors, the male connector having a main body from which a tongue projects, the female connector defining a groove in which said tongue is adapted to lie, the tongue defining shoulder means which, when the connectors are axially connected, come into contact with abutment means formed in the female connector, said contact preventing dislodgement of the connectors until the tongue moves toward said main body to move the shoulder means toward the main body, far enough to break contact between the shoulder means and said abutment means, and an actuator having an attachment portion and an operative portion, the attachment portion being adapted to mount the operative portion so that the operative portion extends adjacent the tongue and projects out of the recess far enough to be manipulated manually transversely so as to move the tongue toward said main body such that the shoulder means moves toward said main body far enough to break contact with the abutment means.

7. The invention claimed in claim 6, in which the attachment portion of the actuator is pivotally mounted adjacent to the female connector.

8. The combination claimed in claim 6, in which the attachment portion of the actuator is configured for lodgement within the female connector and includes contact means for contacting said abutment means, thereby preventing removal of the actuator in the direction in which the operative portion projects, the combination further including mounting means for the female connector, the mounting means including buttress means adjacent the female connector at a location opposite the direction in which the operative portion projects, the buttress means preventing the removal of the actuator in the direction opposite the direction in which the operative portion projects.

9. The invention claimed in claim 6, in which the attachment portion of the actuator has an opening configured to receive the female connector with the operative portion in folded over to extend into the female connector and along the groove.

10. The invention claimed in claim 6, in which the actuator is made of an electrically conductive material.

11. The invention claimed in claim 6, in which the actuator is made of an electrically non-conductive material.

* * * * *